US011433683B2

(12) United States Patent
Meyer et al.

(10) Patent No.: US 11,433,683 B2
(45) **Date of Patent: *Sep. 6, 2022**

(54) INK DELIVERY SYSTEM FOR GROSS AND FINE PRESSURE CONTROL

(71) Applicant: Memjet Technology Limited, Dublin (IE)

(72) Inventors: Craig Meyer, North Ryde (AU); Jason Mark Thelander, North Ryde (AU); Mark Profaca, North Ryde (AU); Stuart Wheatley, North Ryde (AU)

(73) Assignee: Memjet Technology Limited

( * ) Notice: Subject to any disclaimer, the term of this patent is extended or adjusted under 35 U.S.C. 154(b) by 92 days.

This patent is subject to a terminal disclaimer.

(21) Appl. No.: 16/929,019

(22) Filed: Jul. 14, 2020

(65) Prior Publication Data

US 2020/0338901 A1 Oct. 29, 2020

Related U.S. Application Data

(63) Continuation of application No. 16/215,441, filed on Dec. 10, 2018, now Pat. No. 10,744,785, which is a continuation of application No. 15/582,979, filed on May 1, 2017, now Pat. No. 10,252,540.

(60) Provisional application No. 62/330,785, filed on May 2, 2016, provisional application No. 62/330,782, filed on May 2, 2016.

(51) Int. Cl.
*B41J 2/175* (2006.01)
*B41J 2/18* (2006.01)

(52) U.S. Cl.
CPC ..... *B41J 2/17596* (2013.01); *B41J 2/175* (2013.01); *B41J 2/17509* (2013.01); *B41J 2/17556* (2013.01); *B41J 2/18* (2013.01)

(58) Field of Classification Search
CPC ..... B41J 2/17596; B41J 2/17509; B41J 2/18; B41J 2/17556; B41J 2/175
See application file for complete search history.

(56) References Cited

U.S. PATENT DOCUMENTS

| | | | | |
|---|---|---|---|---|
| 9,272,524 | B1 * | 3/2016 | Sugitani | B41J 2/17556 |
| 9,421,780 | B2 * | 8/2016 | Nishiyama | B41J 2/17596 |
| 9,522,542 | B2 * | 12/2016 | Scholz | B41J 2/21 |
| 10,252,540 | B2 * | 4/2019 | Meyer | B41J 2/17596 |

* cited by examiner

*Primary Examiner* — An H Do
(74) *Attorney, Agent, or Firm* — Cooley LLP

(57) ABSTRACT

An ink delivery system for an inkjet printer includes: (a) an ink delivery module for supplying and receiving ink in a circulating fluidic loop having positive and negative pressure ink lines; (b) print modules interconnected between the positive pressure ink line and the negative pressure ink line. The ink delivery module has regulator pumps for gross control of ink pressure in the print modules; and each print module has a respective pressure control system for dynamic fine control of ink pressure in each individual print module.

10 Claims, 3 Drawing Sheets

INK DELIVERY SYSTEM FOR GROSS AND FINE PRESSURE CONTROL

CROSS-REFERENCE TO RELATED APPLICATIONS

The present application is a continuation of U.S. application Ser. No. 16/215,441 filed on Dec. 10, 2018, which is a continuation of U.S. application Ser. No. 15/582,979 filed on May 1, 2017, which claims the benefit of priority under 35 U.S.C. § 119(e) of U.S. Provisional Application No. 62/330,785, entitled INK DELIVERY SYSTEM FOR SUPPLYING INK TO MULTIPLE PRINTHEADS AT CONSTANT PRESSURE, filed May 2, 2016 and of U.S. Provisional Application No. 62/330,782, entitled INK DELIVERY SYSTEM WITH ROBUST COMPLIANCE, filed May 2, 2016, the contents of each of which are hereby incorporated by reference in their entirety for all purposes.

The present application is related to U.S. application Ser. No. 15/582,998 filed on May 1, 2017 and to U.S. application Ser. No. 15/583,099 filed on May 1, 2017, the contents of each of which are hereby incorporated by reference in their entirety for all purposes.

FIELD OF THE INVENTION

This invention relates to an ink delivery system for an inkjet printer. It has been developed primarily for supplying ink to multiple printheads at a relatively constant pressure.

BACKGROUND OF THE INVENTION

Inkjet printers employing Memjet® technology are commercially available for a number of different printing formats, including small-office-home-office ("SOHO") printers, label printers and wideformat printers. Memjet® printers typically comprise one or more stationary inkjet printheads, which are user-replaceable. For example, a SOHO printer comprises a single user-replaceable multicolored printhead, a high-speed label printer comprises a plurality of user-replaceable monochrome printheads aligned along a media feed direction, and a wideformat printer comprises a plurality of user-replaceable printheads in a staggered overlapping arrangement so as to span across a wideformat pagewidth.

Supplying ink to multiple printheads can be problematic as the number of printheads increases. In order to maintain high print quality, each printhead should receive ink at about the same ink pressure from a common ink tank. One system for supplying ink to multiple inkjet printheads is described in U.S. Pat. No. 8,480,211, the contents of which are incorporate herein by reference. In the prior art system, a common accumulator tank incorporating a pressure control system (e.g. float valve regulator) feeds ink to multiple printheads via an ink supply line. A return ink line enables various priming, de-priming and purging operations when the printheads are not printing. However, a problem with the ink delivery system described in U.S. Pat. No. 8,480,211 is that not all printheads necessarily receive the same ink pressure. Printheads furthest from the accumulator tank are affected by pressure drops across printheads closer to the accumulator tank. Hence, there is a tendency for printheads to experience difference ink pressures, especially when printing at full bleed or when different printheads in the system have different ink demands.

It would be desirable to provide an ink delivery system, which supplies ink to multiple printheads at a reliable and highly controlled hydrostatic ink pressure. It would further be desirable to provide a scalable ink delivery system, which can be adapted to supply ink to multiple printheads, the number of which may vary from printing system to printing system.

SUMMARY OF THE INVENTION

In a first aspect, there is provided an ink delivery system for an inkjet printer comprising:

- a positive ink line having a controlled positive ink pressure;
- a negative ink line having a controlled negative ink pressure;
- one or more print modules interconnected between the positive ink line and the negative ink line via respective inlet and outlet lines, each print module comprising:
  - an inlet port connected to the inlet line;
  - an outlet port connected to the outlet line;
  - a printhead interconnected between the inlet port and the outlet port;
  - a control valve positioned at the inlet port for controlling an ink pressure in the printhead;
  - an ink pressure sensor for sensing an ink pressure in the print module; and
  - a controller for receiving feedback from the pressure sensor and controlling
  - the control valve;

wherein, during printing, the ink pressure sensor, the controller and the control valve cooperate to control a backpressure in the printhead within a predetermined backpressure range.

The present invention advantageously provides local pressure control for each printhead in the system. In this way, increasing the number of printheads does not affect the degree of pressure control in the system. Moreover, the present invention interconnects printheads between a positive ("high") and negative ("low") pressure ink lines. This enables excellent local control of pressure using a relatively low tolerance valve at the high pressure side of the printhead; all valve adjustments are dynamically modulated by feedback from the ink pressure sensor. Furthermore, the use of a positive pressure line provides a sufficient head of pressure for multiple printheads without being affected by pressure drops across any of the printheads in the system during printing. These and other advantages will be readily apparent from the detailed description hereinafter.

Preferably, each print module comprises: a supply module having the inlet port and the outlet port; and the printhead.

Preferably, the printhead is contained in a replaceable printhead cartridge releasably connected to the supply module. Each print module may, likewise, be a replaceable unit which can readily detach from the inlet and outlet lines via suitable couplings at the inlet and outlet ports.

Preferably, the supply module comprises:

- an inlet module comprising the inlet port, the control valve and the pressure sensor; and
- an outlet module comprising the outlet port.

Typically, the supply module further comprises suitable drive and logic circuitry for controlling operation of the printhead. For example, the supply module may comprise a print engine controller chip for controlling a respective printhead received by the supply module.

Preferably, the inlet module further comprises an air inlet for introducing air into the printhead and a corresponding air valve. The air inlet and air valve enable de-priming of the printhead, such as when required for printhead cartridge replacement. The operation of an air inlet and air valve for controlling printhead de-priming is described in, for example, U.S. Pat. No. 8,845,083, the contents of which are incorporated herein by reference.

Preferably, the outlet module comprises a stop valve. The outlet module may further comprise a flow restrictor (e.g. orifice), which, in conjunction with the negative ink line, provides backpressure in the printhead. In some embodiments, the flow restrictor may be incorporated into the stop valve.

The outlet module may further comprise, for example, a compliance (e.g. air chamber or flexible-walled chamber) for dampening ink pressure fluctuations.

Preferably, the ink delivery system further comprises an ink reservoir connected to the positive ink line and the negative ink line, such that ink circulates from the ink reservoir to each printhead via the positive ink line and then back to the ink reservoir via the negative ink line.

Preferably, the ink delivery system further comprises an ink delivery module having a positive line coupling connected to the positive ink line, a negative line coupling connected to the negative ink line and a supply coupling for connection to a bulk ink supply tank, wherein ink delivered to the supply coupling is received by the ink reservoir and distributed to the positive and negative line couplings via respective positive and negative pressure regulating systems.

Positive and negative pressure regulating systems advantageously enable gross control of pressure at the printheads by setting predetermined ink pressures in the positive and negative ink lines, while fine local pressure control is achieved using the control valve. Therefore, each control valve is not required to operate at high tolerance, and, moreover, any hysteresis in the control valve and pressure sensor does not significantly affect printhead backpressures.

Preferably, the positive and negative pressure regulating systems comprise respective regulator pumps.

Preferably, the ink delivery module further comprises one or more components selected from the group consisting of:

a positive pressure sensor for sensing positive ink pressure in the positive pressure regulating system;

a negative pressure sensor for sensing negative ink pressure in the negative pressure regulating system;

a positive pressure regulator;

a negative pressure regulator;

a compliance for dampening pressure fluctuations;

an ink filter;

an ink temperature sensor;

an air vent;

an ink level sensor for sensing an ink level in the ink reservoir;

a refill pump positioned between the supply coupling and the ink reservoir; and an ink degasser.

Preferably, the ink delivery system further comprises the bulk ink supply tank connected to the supply coupling. The ink delivery module is typically a self-contained unit, which is connectable to the bulk ink supply, the positive ink line and the negative ink line. In this way, the print modules and the ink delivery module may be provided as a kit enabling users to construct printing systems suitable for their individual needs.

In one embodiment, a positive ink pressure in the positive ink line is controlled by a positive pressure circuit including the ink reservoir, and a negative ink pressure in the negative ink line is controlled by a negative pressure circuit including the ink reservoir, wherein the positive ink line is connected to the positive pressure circuit and the negative ink line is connected to the negative pressure circuit.

Preferably, the ink delivery system comprises a plurality of printheads (e.g. 2 to 50 printheads) wherein the positive ink line is a common positive ink line for each printhead and the negative ink line a common negative ink line for each printhead.

In a second aspect, there is provided a method of controlling a backpressure in one or more printheads, the method comprising the steps of:

supplying ink to each printhead via a positive ink line having a controlled positive ink pressure;

drawing ink from each printhead via a negative ink line having a controlled negative ink pressure; and controlling the backpressure in each printhead by locally controlling a flow of ink at a positive pressure side of each printhead.

Preferably, the backpressure is controlled via a control valve integrated in a print module for each respective printhead.

Preferably, the control valve is controlled by a controller receiving feedback from an ink pressure sensor in the print module.

Preferably, ink is supplied to the positive ink line from an ink reservoir via a positive pressure circuit, and ink is drawn from each printhead back to the ink reservoir via a negative pressure circuit.

In a third aspect, there is provided a kit comprising:

(A) an ink delivery module comprising:

a supply coupling for connection to a bulk ink supply;

an ink reservoir for receiving ink from the supply coupling;

a positive line coupling for connection to a positive ink line;

a negative line coupling for connection to a negative ink line;

a positive pressure regulating system for regulating ink pressure between the ink reservoir and the positive line coupling; and a negative pressure regulating system for regulating ink pressure between the ink reservoir and the negative line coupling; and (B) one or more print modules, each print module comprising:

an inlet port;

an outlet port;

a printhead interconnected between the inlet port and the outlet port;

a control valve positioned at the inlet port for controlling an ink pressure in the printhead;

an ink pressure sensor for sensing an ink pressure in the print module; and a controller for receiving feedback from the pressure sensor and controlling the control valve.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
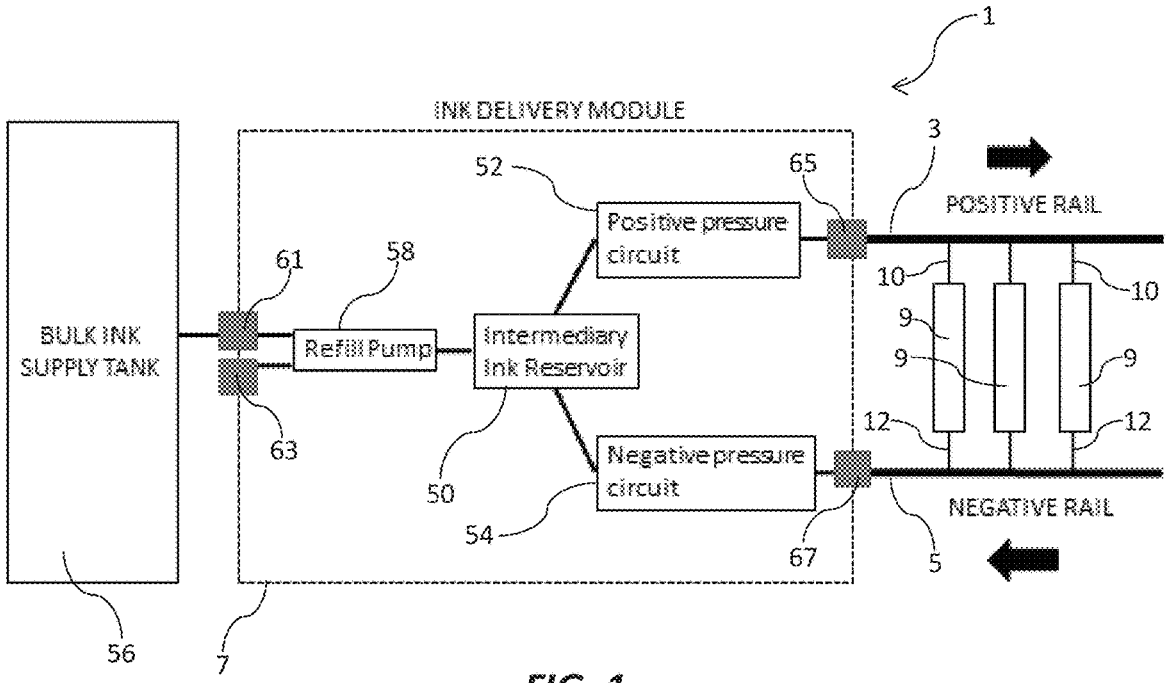
FIG. 1 shows schematically an ink delivery system according to the present invention.

Referring to FIG. 1, there is shows schematically an ink delivery system 1 comprising a positive ink line 3 ("positive rail") and a negative ink line 5 ("negative rail") connected to an ink delivery module 7, which regulates the ink pressure in each of the positive and negative ink lines. A plurality of print modules 9 are interconnected between the positive ink line 3 and the negative ink line 5 via respective inlet and outlet lines 10 and 12. Although three print modules 9 are shown in FIG. 1, it will be appreciated that any number of print modules may be interconnected between the positive ink line 3 and the negative ink line 5. Print modules 9 may be physically positioned in a staggered overlapping arrangement so as to extend across a print zone media wider than an individual print module. In this way, multiple print modules 9 may be employed for printing onto print media having widths of more than about 8 inches (e.g. at least 16 inches, at least 32 inches or at least 40 inches).

Figure 3:
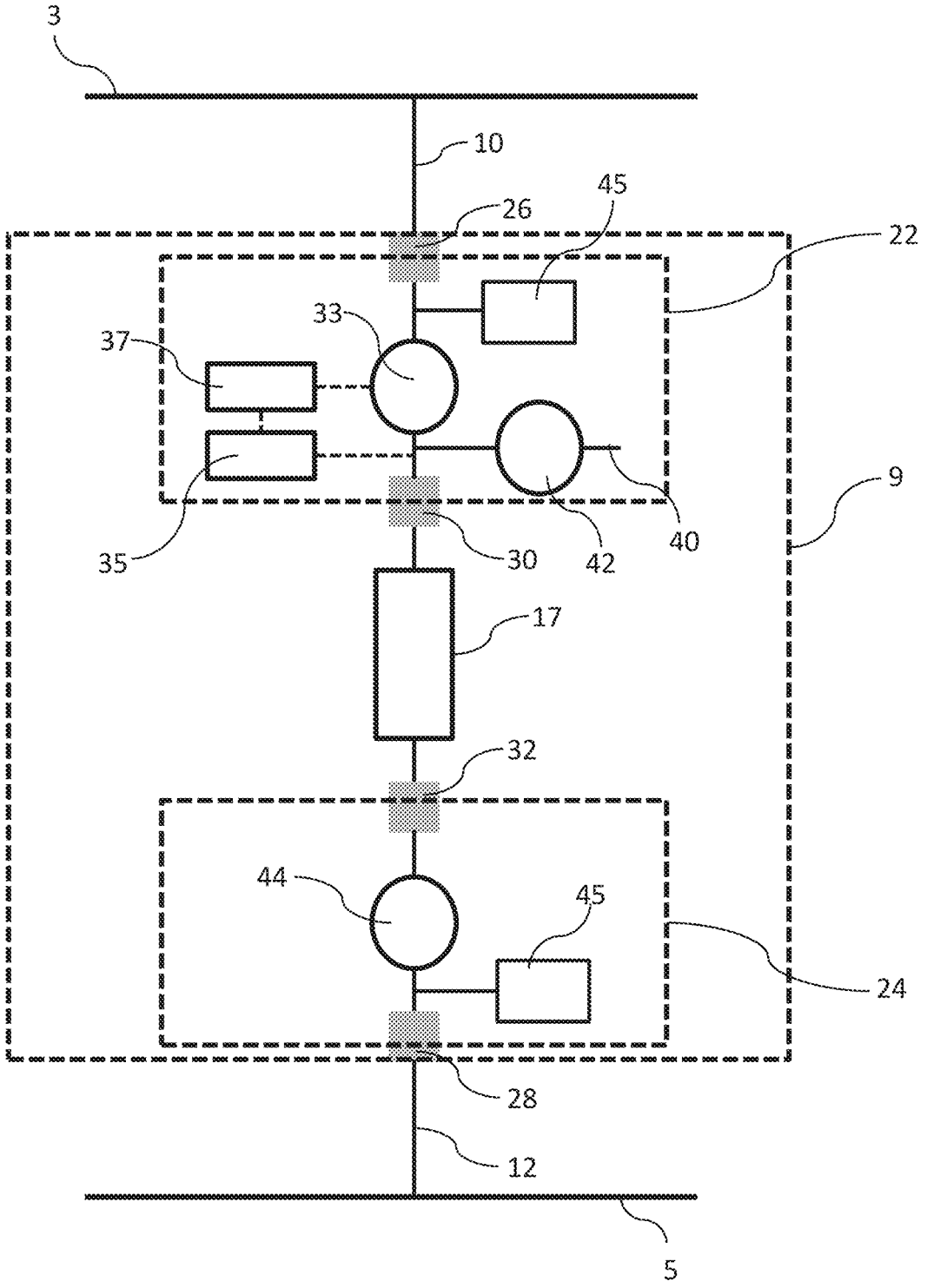
FIG. 3 shows schematically a print module interconnected between positive and negative ink lines.
Figure 4:
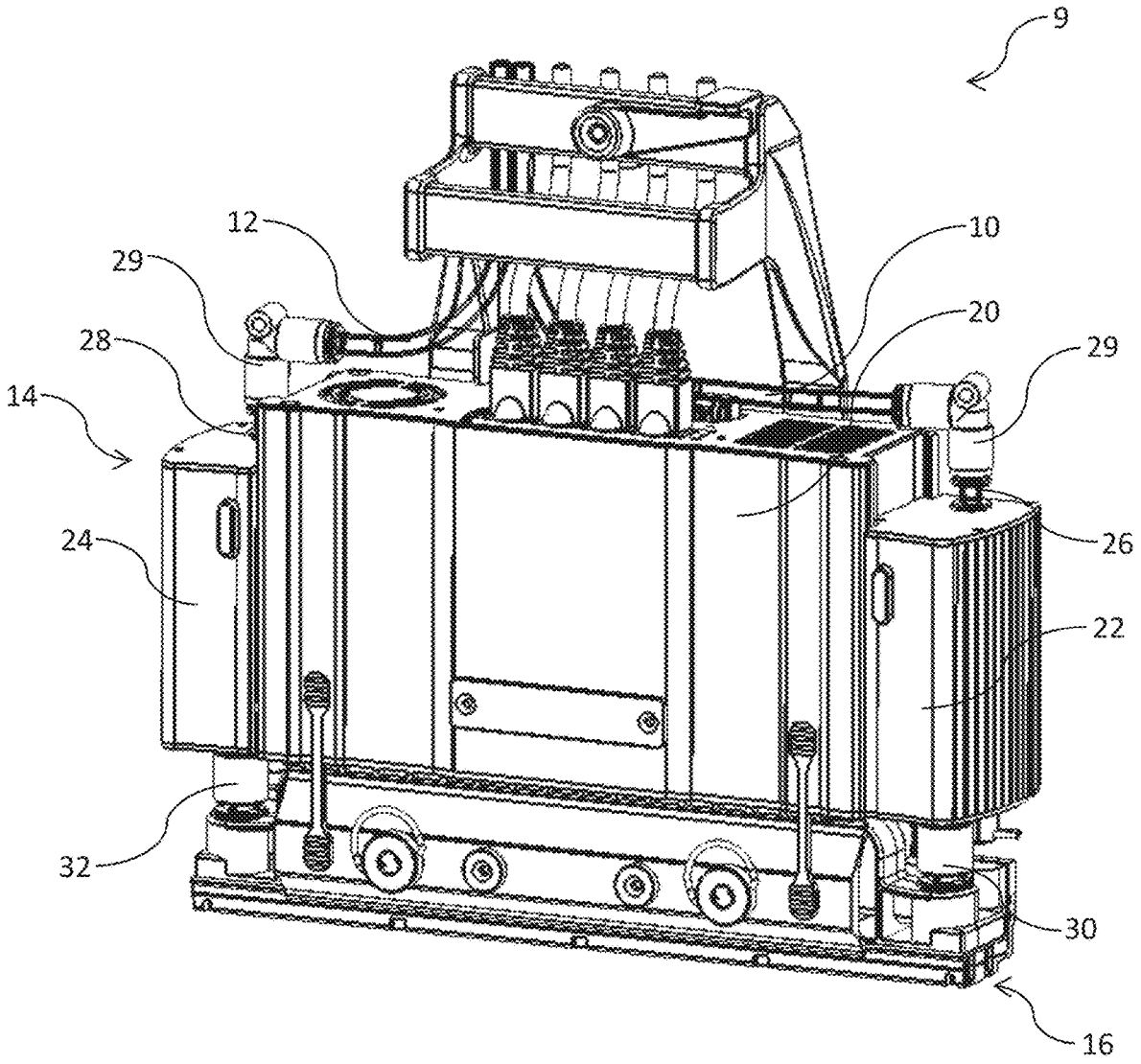
FIG. 4 is a perspective view of a print module.

Referring now to FIGS. 3 and 4, an individual print module 9 is comprised of a supply module 14 and a printhead cartridge 16 releasably connected to the supply module. The printhead cartridge 16 comprises an inkjet printhead 17 for printing onto print media and may be a color or monochrome printhead (e.g. two color or four color printhead), as known in the art. For example, the printhead may be of the type described in the Applicant's U.S. Pat. No. 10,399,354, the contents of which are incorporated herein by reference. In the interests of clarity, an ink delivery system for one color of ink is described herein, although it will be appreciated that multiple ink delivery systems may be used for supply of multiple colors of ink.

The supply module 14 comprises a body 20 housing drive and logic circuitry (e.g. one or more PCBs having a print engine controller chip, drive transistors etc.) for the printhead 17, as well as an inlet module 22 and an outlet module 24. The inlet module 22 has an inlet port 26 connected to the inlet line 10, and the outlet module 24 has an outlet port 28 connected to the outlet line 12. Suitable print module couplings 29 allow convenient replacement of entire print modules, when required.

The printhead cartridge 16 is fluidically connected to the supply module 14 by means of printhead inlet and outlet couplings 30 and 32. The printhead inlet and outlet couplings 30 and 32 are typically quick-connect couplings which enable convenient removal of a spent printhead cartridge 16 from each print module 9 and replacement with a new printhead cartridge by the user.

The inlet module 22 contains all the necessary components for providing local control of ink pressure in the printhead 17 for a respective print module 9. Thus, each print module 9 provides local, independent control of ink pressure in its respective printhead 17, so that local ink pressures can be fine-tuned automatically and in response to localized pressure fluctuations.

The inlet module 22 contains a control valve 33, which regulates ink pressure dynamically in response to feedback from an ink pressure sensor 35 sensing ink pressure downstream of the control valve. The ink pressure sensor 35 provides feedback to a controller 37 (e.g. microprocessor), which in turn controls a variable position of the control valve 33 so as to regulate ink pressure in the printhead 17 within a predetermined backpressure range. Notably, the control valve 33 allows fine control of ink pressure with minimal hysteresis by virtue of being connected between the positive and negative ink lines 3 and 5, which already provide gross control of ink pressure. Hence, relatively large adjustments of the control valve 33 produce only relatively small changes in ink pressure in the print module 9.

Additionally, the inlet module 22 comprises an air inlet 40 for introducing air into the printhead and a corresponding air valve 42, which can shut off air flow into the printhead. The air valve 42 is typically a solenoid valve, which may be controlled by the controller 37. For most operations the air valve 42 is closed. However, when it is necessary to deprime the printhead 16 (e.g. for replacement of a printhead cartridge 17), the air valve 42 is opened with the control valve 33 fully closed so as to draw air into the printhead 16 and remove ink.

The outlet module 24 comprises a shut-off valve 44 for isolating the print module 9, in combination with the control valve 33, when required. The shut-off valve 44 incorporates a flow restrictor in the form an orifice which restricts ink flow and controls backpressure in the printhead 17 in combination with the negative ink line 5.

In the embodiment shown in FIG. 3, both the inlet module 22 and the outlet module 24 each comprises a compliance 45 (e.g. an air chamber or flexible-walled chamber) proximal the respective inlet and outlet ports 26 and 28 for dampening ink pressure fluctuations or 'spikes'.

Returning to FIG. 1, the ink delivery module 7 comprises an intermediary ink reservoir 50 which is connected to the positive ink line 3 via a positive pressure regulating system in the form of a positive pressure circuit 52. Likewise, the intermediary ink reservoir 50 is connected to the negative ink line via a negative pressure regulating system in the form of a negative pressure circuit 54. The intermediary ink reservoir is vented to atmosphere via, for example, a serpentine vent path (not shown). The positive pressure circuit 52 regulates a positive ink pressure in the positive ink line 3, while the negative pressure circuit 54 regulates a negative ink pressure in the negative ink line 5. During printing, ink circulates from the intermediary ink reservoir 50 into the positive ink line 3, through each print module, 8 and returns to the intermediary ink reservoir via the negative ink line 5.

The intermediary ink reservoir 50 is replenished with ink from a bulk ink supply tank 56 via a refill pump 58 in the ink delivery module 7. The intermediary ink reservoir 50 has suitable ink sensors (not shown) for detecting a low ink level and providing feedback for actuating the refill pump 58 when required.

The ink delivery module 7 is typically a self-contained unit with various external couplings: a supply coupling 61 for connecting the refill pump 58 to the bulk ink supply tank 56; an overflow coupling 63 for connecting the refill pump to an overflow tank (now shown); a positive line coupling 65 for connecting the positive ink line 3 to the positive pressure circuit 52; and a negative line coupling 67 for connecting the negative ink line 5 to the negative pressure circuit 54.

Figure 2:
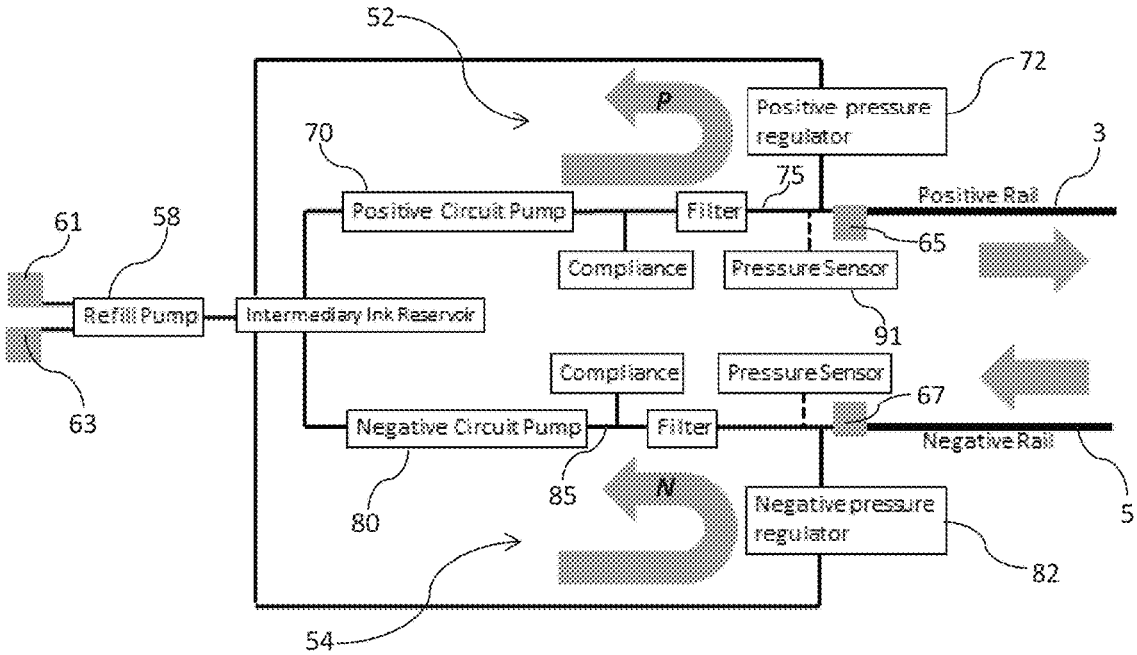
FIG. 2 shows schematically an ink delivery module for connection to positive and negative ink lines.

Turning now to FIG. 2, the internal components of the ink delivery module 7 are shown in more detail. In particular, the positive pressure circuit 52 comprises a positive circuit pump 70, which pumps ink from the intermediary ink reservoir 50 towards a positive pressure regulator 72. Ink between the positive circuit pump 70 and the positive pressure regulator 72 is maintained at a regulated positive pressure, and the positive ink line 3 is tapped from this regulated portion 75 of the positive pressure circuit 52 via the positive line coupling 65. Downstream of the positive pressure regulator 72, ink is at unregulated pressure and returns to the intermediary ink reservoir 50 in the direction indicated by the arrow P in FIG. 4.

Similarly, the negative pressure circuit 54 comprises a negative circuit pump 80, which pumps ink from the intermediary ink reservoir 50, through a negative pressure regulator 82 and into a pump inlet of the negative circuit pump. Ink between the negative pressure regulator 82 and the negative circuit pump 80 and is maintained at a regulated negative pressure, and the negative ink line 5 is tapped from this regulated portion 85 of the negative pressure circuit 54 via the negative line coupling 67. Downstream of the negative circuit pump 80, ink is at unregulated pressure and returns to the intermediary ink reservoir 50 in the direction indicated by the arrow N in FIG. 4.

In each of the positive and negative pressure circuits 52 and 54, a pressure sensor 91 provides feedback to the respective positive and negative pressure regulators 72 and 82. Therefore, the regulated portions 75 and 85 of each circuit are maintained at optimum positive and negative pressures, respectively. Each of the positive and negative pressure circuits 52 and 54 further comprises a filter for filtering particulates from ink and a compliance for dampening ink pressure fluctuations. The ink delivery module 7 may also comprise a degasser, as known in the art, for removing air bubbles from the ink before it is delivered to the print modules 9.

It will, of course, be appreciated that the ink delivery module 7 may comprise alternative positive and negative pressure regulating systems. For example, the positive and negative pressure circuits 52 and 54 may be absent and the ink delivery module 7 may provide inline regulation of ink pressures between the intermediary ink reservoir 50 and the positive and negative line couplings 65 and 67.

During printing, ink at a regulated positive pressure is supplied to the positive ink line 3. Each print module 9 draws ink from the positive ink line 3 and the ink is fed back to the ink delivery module 7 at a regulated negative pressure via the negative ink line 5. By maintaining control of the relative positive and negative pressures in the positive and negative ink lines 3 and 5, a relatively constant backpressure is provided at each print module 9. Additional local control of backpressure in each printhead 17 is provided by the control valve 33 in the input module 22 of each print module 9. The control valve 33 is adjustable using feedback from the ink pressure sensor 35 to maintain optimum backpressure. When the pressure is too high, the control valve 33 is closed somewhat; when the pressure is too low, the control valve 33 is opened somewhat.

Accordingly, the present invention provides excellent control of printhead backpressures in a number of printheads 17 which are supplied with ink from a common ink reservoir. The combination of bulk pressure regulation via the ink delivery module 7 and local pressure regulation via the control valve 33 in each print module 9 ensures that each printhead 17 has sufficient ink pressure for different ink demands and, further, that each printhead in the system is maintained at a relatively constant backpressure. Moreover, the ink delivery system 1 is scalable for use with any number of print modules 9 (e.g. from 1 to 50 print modules).

It will, of course, be appreciated that the present invention has been described by way of example only and that modifications of detail may be made within the scope of the invention, which is defined in the accompanying claims.

The invention claimed is:

1. An ink delivery system for an inkjet printer comprising:

(a) an ink delivery module for supplying and receiving ink in a circulating fluidic loop having positive and negative pressure ink lines;

(b) one or more print modules interconnected between the positive pressure ink line and the negative pressure ink line, wherein:

the ink delivery module comprises one or more regulator pumps for gross control of ink pressure in the print modules; and each print module comprises a respective pressure control system for dynamic fine control of ink pressure in each individual print module.

2. The ink delivery system of claim 1, wherein the ink delivery module comprises a positive regulator pump and a negative regulator pump.

3. The ink delivery system of claim 1, wherein each print module comprises a respective replaceable inkjet printhead.

4. The ink delivery system of claim 1, wherein each pressure control system comprises:

a control valve positioned at an inlet port of the print module;

an ink pressure sensor for sensing an ink pressure in the print module; and a controller for receiving feedback from the pressure sensor and controlling the control valve in response to the feedback from the pressure sensor;

wherein, during printing, the ink pressure sensor, the controller and the control valve cooperate to control the ink pressure in the print module within a predetermined backpressure range.

5. The ink delivery system of claim 4, wherein each print module further comprises an air inlet and a corresponding air valve.

6. The ink delivery system of claim 4, wherein each print module further comprises a stop valve or a flow restrictor.

7. The ink delivery system of claim 1, wherein the ink delivery module comprises an ink reservoir connected to the positive and negative pressure ink lines, such that ink circulates from the ink reservoir to each print module via the positive pressure ink line and then back to the ink reservoir via the negative pressure ink line.

8. The ink delivery system of claim 7, wherein the ink delivery module further comprises one or more components selected from the group consisting of:

a positive pressure sensor for ink pressure in the positive pressure ink line;

a negative pressure sensor for sensing ink pressure in the negative ink line;

a compliance for dampening pressure fluctuations;

an ink filter;

an ink temperature sensor;

an air vent;

an ink level sensor for sensing an ink level in the ink reservoir;

a refill pump for pumping ink to the ink reservoir from a bulk ink supply; and an ink degasser.

9. The ink delivery system of claim 1, wherein the positive and negative pressure ink lines are common to all print modules.

10. The ink delivery system of claim 1, wherein the inkjet printer is a digital inkjet press.

* * * * *